US006425459B1

(12) United States Patent
Keefer

(10) Patent No.: US 6,425,459 B1
(45) Date of Patent: Jul. 30, 2002

(54) AERIAL WORK PLATFORM APPARATUS WITH ANTI-TIPPING SUPPLEMENT

(75) Inventor: Richard E. Keefer, Lincoln, NE (US)

(73) Assignee: Snorkel International, Inc., St. Joseph, MO (US)

( * ) Notice: Subject to any disclaimer, the term of this patent is extended or adjusted under 35 U.S.C. 154(b) by 0 days.

(21) Appl. No.: 09/860,928

(22) Filed: May 18, 2001

(51) Int. Cl.[7] ..... B66B 11/04; E06C 1/00

(52) U.S. Cl. ..... 182/69.5; 182/63.1; 182/141; 280/764.1; 280/755

(58) Field of Search ..... 182/63.1, 69.5, 182/79.2, 18, 134, 141; 280/764.1, 755

(56) References Cited

U.S. PATENT DOCUMENTS

| | | | | |
|---|---|---|---|---|
| 803,717 | A | * 11/1905 | Schwarz et al. | 182/69.5 X |
| 931,702 | A | * 8/1909 | Otter | 182/69.5 |
| 1,261,633 | A | * 4/1918 | Shuford | 182/69.5 |
| 1,581,660 | A | * 4/1926 | Rosgaard | 182/69.5 X |
| 2,086,255 | A | * 7/1937 | Cashier et al. | 182/69.5 |
| 2,100,066 | A | * 11/1937 | Buchheit | 182/69.5 |
| 2,408,500 | A | 10/1946 | West | |
| 2,759,563 | A | 8/1956 | Marnon et al. | |
| 3,528,675 | A | 9/1970 | Brown | |
| 3,581,993 | A | * 6/1971 | Reams | 239/167 |
| 3,730,547 | A | 5/1973 | Young | |
| 3,850,111 | A | 11/1974 | Hansen | |
| 3,876,018 | A | * 4/1975 | Mracek et al. | 177/132 |
| 4,175,644 | A | 11/1979 | Sikli | |
| 4,401,408 | A | 8/1983 | Gibert | |
| 4,572,012 | A | 2/1986 | Laney | |
| 4,815,756 | A | 3/1989 | Kitner | |
| 5,402,737 | A | * 4/1995 | Kanazawa | 108/147 |
| 5,439,343 | A | 8/1995 | Watson | |
| 5,467,838 | A | 11/1995 | Wu | |
| 5,538,149 | A | * 7/1996 | Martin | 212/278 |
| 5,685,563 | A | 11/1997 | Ottestad | |
| 5,890,737 | A | 4/1999 | Hutka | |
| 6,113,356 | A | 9/2000 | Eller et al. | |

OTHER PUBLICATIONS

Snorkel/Economy Engineering Company, A Figgie International Company; SM–1000 Series Scissors Push Around/Towable Work Platforms: Sales Features and Benefits; published at least as early as May 18, 2000; 2 pages; Bensenville, Illinois, U.S.A.

Snorkel/Economy Engineering Company, A Figgie International Company; Barecat: 25'Self–Propelled Work Platform; Jan. 1988; 3 pages; Bensenville, Illinois, U.S.A.

Snorkel/Economy Engineering Company, A Figgie International Company; Barecat: Self–Propelled Elevating Work Platform; published at least as early as May 18, 2000; 1 page; Bensenville, Illinois, U.S.A.

Snorkel/Economy Engineering Company, A Figgie International Company; Wildcat: Cat–A–Lever, Nov. 1987; 6 pages; Bensenville, Illinois, U.S.A.

Snorkel/Economy Engineering Company, A Figgie International Company; Wildcat 3000: Aerial Work Platforms; published at least as early as May 18, 2000; 1 page; Bensenville, Illinois, U.S.A.

(List continued on next page.)

*Primary Examiner*—Bruce A. Lev
(74) *Attorney, Agent, or Firm*—Senniger, Powers, Leavitt & Roedel

(57) ABSTRACT

Aerial work platform apparatus comprising a vehicle, a work platform, a lift on the vehicle for elevating and lowering the work platform, and a stabilizer for inhibiting tipping over of the apparatus when the work platform is elevated. The stabilizer is mounted on the vehicle for movement between a raised retracted position and a lowered position for engagement with the surface traversed by the vehicle should the apparatus start tipping. A mechanism moves the stabilizer between its raised and lowered positions.

18 Claims, 6 Drawing Sheets

OTHER PUBLICATIONS

Snorkel/Economy Engineering Company, A Figgie International Company; 5000 Series: Aerial Work Platforms; published at least as early as May 18, 2000; 2 pages; Bensenville, Illinois, U.S.A.

Snorkel/Economy Engineering Company, A Figgie International Company; New SL–A Series Snorkelift: Rough Terrain Scissorlift; published at least as early as May 18, 2000; 1 page; Bensenville, Illinois, U.S.A.

Snorkel/Economy Engineering Company, A Figgie International Company; CUB: Self–Propelled Elevating Work Platform; published at least as early as May 18, 2000; 1 page; Bensenville, Illinois, U.S.A.

Snorkel; Design Drawings for Pothole Protector Interlock; published at least as early as May 18, 2000; 3 pages; Bensenville, Illinois, U.S.A. (these drawings are admitted to be prior art).

* cited by examiner

AERIAL WORK PLATFORM APPARATUS WITH ANTI-TIPPING SUPPLEMENT

BACKGROUND OF THE INVENTION

This invention relates to an aerial work platform apparatus with an anti-tipping supplement, more particularly to mobile elevating work platform apparatus comprising a scissors-type lift on a vehicle for lifting and lowering a work platform with a supplemental (complementary) system for stabilizing the apparatus when the work platform is lifted to inhibit the tipping over of the apparatus, especially in a situation where the vehicle encounters uneven going, such as when a wheel of the vehicle goes down in a pothole or up on a bump causing the apparatus to tilt.

The invention is generally in the field of apparatus such as disclosed in U.S. Pat. No. 5,890,737 dated Apr. 6, 1999 entitled "Pothole Protection Mechanism for a Lifting Device", to which reference may be made for a discussion of the tip-over problem encountered by mobile elevating work platform lifts, particularly those comprising a scissors-type lift on a wheeled vehicle. The invention may be regarded as involving an improvement thereover and, more to the point, may be regarded as an improvement on a prior apparatus sold by the assignee of this application having a bar which is reciprocal generally horizontally on the vehicle in forward and rearward direction relative to the vehicle in response to lifting and lowering of the work platform for rotating forward and rearward horizontally extending shafts linked to stabilizers on opposite sides of the vehicle for lowering the stabilizers from a raised retracted position to a lowered stabilizing position on the lifting of the platform and raising the stabilizers to retracted position on the lowering of the platform.

BRIEF SUMMARY OF THE INVENTION

Among the several objects of the invention may be noted the provision of aerial work platform apparatus with an improved anti-tipping system; the provision of such apparatus in which the anti-tipping system has a reduced total of parts and a reduced quantity of different parts; the provision of such apparatus in which the anti-tipping system is most effectively self-locking; and the provision of such apparatus in which the anti-tipping system is of relatively economical construction as to both components and fabrication.

In general, aerial work platform apparatus of this invention comprises a vehicle, a work platform, a lift on the vehicle for elevating and lowering the work platform, and a stabilizer for inhibiting tipping over of the apparatus when the work platform is elevated. The stabilizer is mounted on the vehicle for movement between a raised retracted position and a lowered position for engagement with the surface traversed by the vehicle should the apparatus start tipping. A drawbar is mounted on the vehicle for generally vertical reciprocation movable up on rise of the lift and down in response to lowering of the lift, and mechanism operable by the drawbar has a connection with the stabilizer for moving the stabilizer up to its raised retracted position on lowering the lift with accompanying downward movement of the drawbar and down to its lowered position on rise of the lift with accompanying upward movement of the drawbar.

In one embodiment, two stabilizers are provided for inhibiting tipping over of the apparatus when the work platform is raised. Each stabilizer extends longitudinally of the vehicle, one at one side and the other at the other side of the vehicle, and each comprises a bar mounted on the vehicle for movement between a raised retracted position and a lowered position for engagement with the surface traversed by the vehicle. A drawbar is mounted on the vehicle for generally vertical reciprocation movable up on rise of the lift and down in response to lowering of the lift. Two drawbar-operated stabilizer operating mechanisms are provided, one for the one stabilizer and the other for the other stabilizer. Each such mechanism is operable by the drawbar and has a connection with the respective stabilizer for moving the respective stabilizer up to its raised retracted position on lowering the lift with accompanying downward movement of the drawbar and down to its lowered position on rise of the lift with accompanying upward movement of the drawbar.

In a preferred embodiment, the aerial work platform apparatus comprises a vehicle, a work platform, and a scissors lift on the vehicle for elevating and lowering the work platform. Two stabilizers are provided for inhibiting tipping over of the apparatus when the scissors lift is raised to elevate the work platform. Each stabilizer extends longitudinally of the vehicle, one at one side and the other at the other side of the vehicle, and each comprises a bar having arms thereon pivoted on the vehicle for swinging movement on a generally horizontal axis extending longitudinally of the vehicle between a raised retracted position wherein the arms extend inward from the respective side and a lowered position extending downward for engagement with the surface traversed by the vehicle. A double-sided rack is mounted on the vehicle for generally vertical reciprocation between a lowered retracted position and a raised position movable up to its raised position on rise of the scissors lift and down to its retracted position in response to lowering of the lift. Two pinions, one on each side of the rack, each having a crank pin thereon, are mounted on the vehicle for rotation by the rack on a horizontal axis between a retracted position and an advanced position of the crank pin. Two links extend transversely of the vehicle, each interconnecting a respective crank pin and a respective stabilizer arm for swinging of the stabilizer bars to their lowered position on upward movement of the rack in response to rise of the lift and to their retracted position on downward movement of the rack on lowering of the lift.

In another aspect of this invention, the aerial work platform apparatus includes a vehicle, a work platform on the vehicle, and a lift on the vehicle for raising and lowering the work platform. The apparatus also includes a stabilizer extending lengthwise of the vehicle when the work platform is elevated, mounted on the vehicle for movement between a raised retracted position and a lowered position for engagement with the surface traversed by the vehicle should the apparatus start tipping. Mechanism is provided for moving the stabilizer up to its raised retracted position on lowering the lift and down to its lowered position on rise of the lift. This mechanism comprises, in one embodiment, a crank mounted on the vehicle for rotation on an axis extending lengthwise of the vehicle between a retracted angular position and an advanced angular position, the crank being rotatable from the retracted to the advanced position on rise of the lift and from the advanced position to the retracted position on lowering of the lift. The mechanism also includes a link extending transversely of the vehicle interconnecting the crank and stabilizer for moving the stabilizer up to its raised retracted position on the rotation of the crank on lowering the lift and down to its lowered position on the reverse rotation of the crank on rise of the lift.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
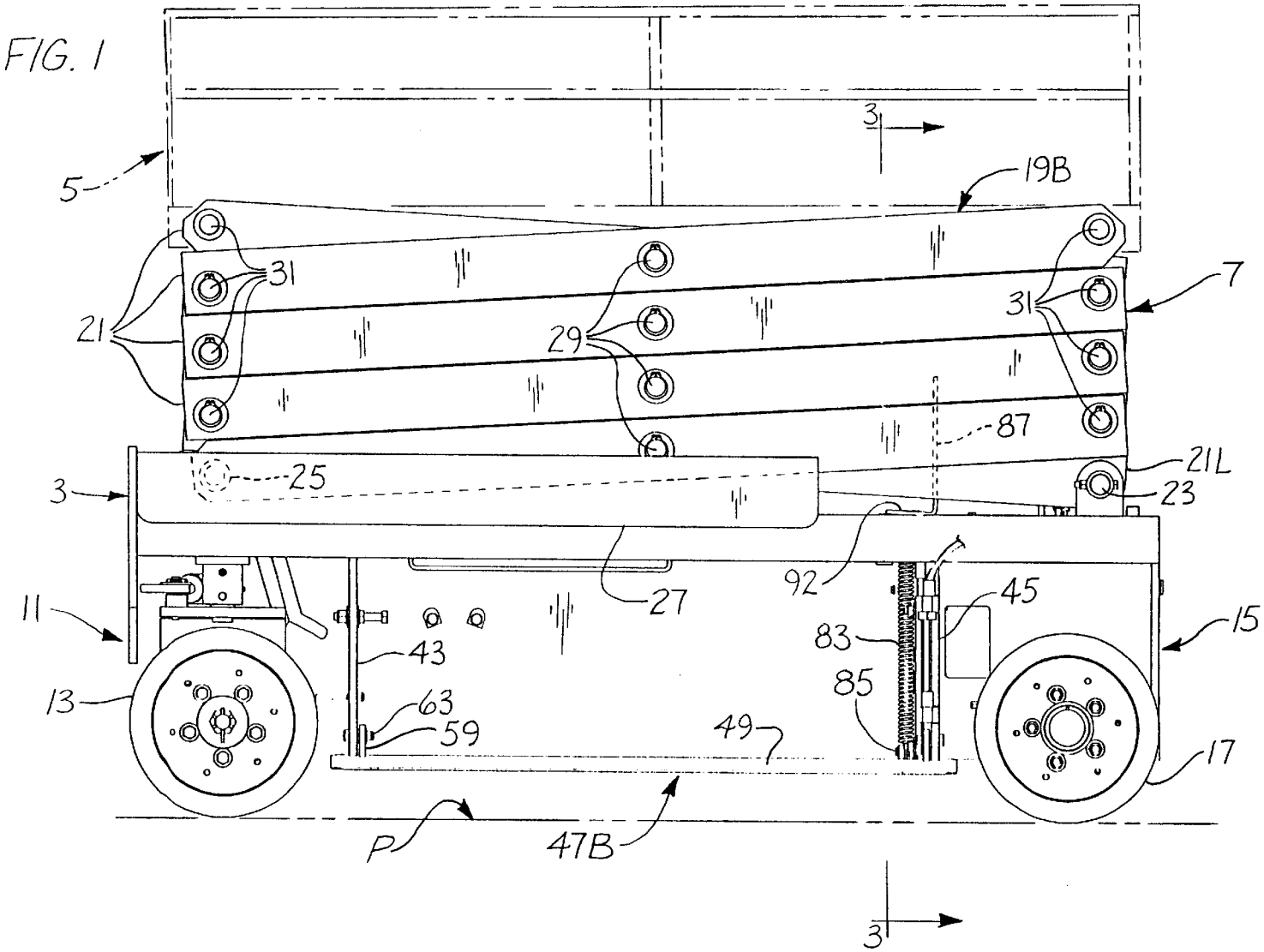
FIG. 1 is a view in side elevation of an aerial work platform apparatus wherein the work platform is on a scissors lift on a vehicle, the apparatus being equipped with an anti-tipping supplement of this invention, showing the scissors lift in its lowered (contracted) mode and the work platform thereby in lowered position, the work platform being illustrated in phantom.

Referring to FIGS. 1–4, aerial work platform apparatus of this invention designated 1 in its entirety, is shown to comprise a wheeled vehicle 3, an aerial work platform 5, and a lift 7 on the vehicle carrying the platform for elevating and lowering it. The wheels at one end 11 of the vehicle (those for steering the vehicle) are designated 13, the wheels at the other end 15 are designated 17. The lift 7 is a scissors lift, comprising a series or "stack" 19A of pairs of crossed links 21 on one side of the vehicle and a series or stack 19B of pairs of crossed links 21 on the other side of the vehicle, the one side being designated the A side and the other the B side. One link of the lowermost pair of crossed links of each series, specially designated 21L, is pivoted at its lower end as indicated at 23 on a pivot extending transversely of the vehicle adjacent its end 15, the other link of said pair being pivoted at its lower end on a pivot as shown in phantom at 25 in FIGS. 1 and 2 extending transversely of the vehicle slidable in tracks 27 extending lengthwise of the vehicle. Pivots at the link crossings are indicated at 29 and at the link ends are indicated at 31. The scissors lift 7 is adapted to be extended upwardly for elevating the platform and to be collapsed for lowering the platform by means of a hydraulic cylinder 33 (see FIG. 2) having its head end pivoted at 35 on the vehicle and piston rod 37 connected to the scissors as indicated at 41. As thus far described, the apparatus is of relatively conventional construction.

For purposes of this invention, the vehicle is constructed with a transversely extending panel or bulkhead 43 in a vertical plane adjacent its end 11 and a transversely extending panel or bulkhead 45 in a vertical plane adjacent its end 15, these panels or bulkheads being relatively widely spaced lengthwise of the vehicle and parallel to one another. Two stabilizers for inhibiting tipping over of the apparatus 1 when the work platform 5 is raised extend longitudinally of the vehicle between the bulkheads 43, 45, one designated 47A at one side (the A side) of the vehicle and the other designated 47B at the other side (the B side) of the vehicle. In one embodiment, each of the stabilizers comprises an elongate flat bar 49 (a relatively long bar of a rectangular cross-section the wide faces of which are designated 51 and 53 and the narrow faces or edges of which are designated 55 and 57) on pivot arms or levers 59 adjacent the ends of the bar which serve as pivoting supports for pivotally mounting the stabilizer on the bulkheads 43, 45 of the vehicle for swinging movement of the stabilizer between a raised fully retracted (inactive) position (see FIGS. 1, 3 and 5) and a lowered (active) position (see FIGS. 2, 4 and 6).

Each stabilizer pivot arm 59, there being four in all, two for each stabilizer, adjacent each end of each of the two bars 49, is constituted by a generally elongate flat piece having a hole 61 at one end for a bolt 63 serving as a pivot, a recess 65 in one edge of the piece in which the respective bar is fitted and secured (as by welding) and a hole 67 adjacent its other end serving to receive a bolt 69 for pin-connection of a link or connecting rod 71 as well be subsequently described. The pivot arms 59 are pivoted on the bulkheads 43 and 45 by the bolts 63 for the swinging of each stabilizer between the stated raised retracted (inactive) position (FIGS. 1, 3 and 5) and the lowered active (FIGS. 2, 4 and 6) position. In the raised retracted position, arms 59 extend inward from pivots 63 toward the central vertical plane of the vehicle and bars 49 occupy a fully raised approximately horizontal position (see FIG. 5 particularly). In the lowered position, arms 59 extend generally downward from pivots 63 and bars 49 occupy a lowered approximately vertical position with edges 57 thereof down and generally at a level spaced a relatively small distance above the plane of the bottoms of the wheels 13, 17 so as not to impede travel of the vehicle, and adapted on downward movement through said small distance for engagement with the surface traversed by the vehicle should the apparatus tilt slightly.

At 73 is indicated a drawbar which is mounted on the bulkhead 45 of the vehicle for generally vertical reciprocation, being movable up on rise of the lift 7 and down in response to lowering of the lift, for operating mechanism generally designated 75A on one side of the vehicle for operating the stabilizer 47A on that side, and also for operating mechanism generally designated 75B on the other side of the vehicle for operating the stabilizer 47B on that side. Each mechanism 75A and 75B includes an aforesaid link or connecting rod 71 serving as a connection with the respective stabilizer for moving it up to its raised retracted position on lowering the lift with accompanying downward movement of the drawbar 73 and for moving it down to lowered position on rise of the lift with accompanying upward movement of the drawbar 73.

The drawbar 73 is mounted for sliding movement up and down on the inwardly facing face of bulkhead 45 and is maintained in assembly therewith by means of a bolt 77 extending horizontally in longitudinal direction with respect to he vehicle through a bolt hole in bulkhead 45 and through a vertical slot 79 in the drawbar, being held against the face of the bulkhead 45 by a washer 81 on the bolt. The drawbar 73 is biased to slide upwardly to an upper limit constituting its raised position by a coil tension spring 83 connected between the bolt 77 and a bolt 85 fastened on the drawbar adjacent its lower end. Thus, the drawbar is vertically slidable between its raised position (upper limit) as determined by engagement of the lower end of slot 79 with the fixed bolt 77, and a lower position (lower limit), as determined by engagement of the upper end of the slot 79 with bolt 77, being biased up toward its raised position (upper limit) by the spring 83. It is adapted to be driven down from its raised to its lowered position by a driver constituted by a pusher 87 of T-shape adjustably fastened as indicated at 89 to a crossbar 91 extending between an intermediate pair of links 21 of the scissors lift 7, the driver having a foot 92 engageable with the upper end 73E of the drawbar on lowering of the lift, and being movable back up to its raised position by the spring 83 when the lift is raised and moves up.

The drawbar 73 is formed as a double-sided rack engageable on one side with a pinion 93A constituting an element of stabilizer operating mechanism 75A and on the other side with a pinion 93B constituting an element of stabilizer operating mechanism 75B, the stabilizer operating mechanisms 75A, 75B being essentially identical but reversely arranged on opposite sides of the drawbar. Each pinion 93A, 93B is rotatable through the predetermined angle illustrated at C (FIG. 5) by the drawbar/rack 73 on the downward and upward movement thereof. The drawbar is formed as the double-sided rack by having a set of notches 95 in one side edge thereof and a similar set of notches 95 in the other side edge thereof, the notches being spaced at intervals along the length (height) of the drawbar, the rack teeth thereby formed (between notches) being indicated at 97. Each pinion 93A, 93B comprises a disk-like element mounted on the aforesaid face of bulkhead 45 for rotation at what is generally the center thereof on an axis extending longitudinally of the vehicle on the respective side of the drawbar/rack on a bolt 99 extending through a hole in the bulkhead 45. Each disk-like element 93A, 93B has a plurality of pins 101 thereon spaced at intervals corresponding to the spacing of the notches 95 in the side edges of the drawbar/rack on a circle centered on the bolt 99 for engagement by the respective rack teeth 97 to effect rotation thereof. Each pinion acts as a crank, having a crank pin 103 thereon on a radius somewhat greater than the radius of the circle on which pins 101 lie. Each pinion/crank 93A, 93B is connected (linked) to a respective stabilizer arm 59 by one of the links (or connecting rods) 71, extending between the respective crank pin 103 and a pin connection at 69 with the arm 59 of the respective stabilizer 47A, 47B, on the respective side A, B of the vehicle.

Figure 2:
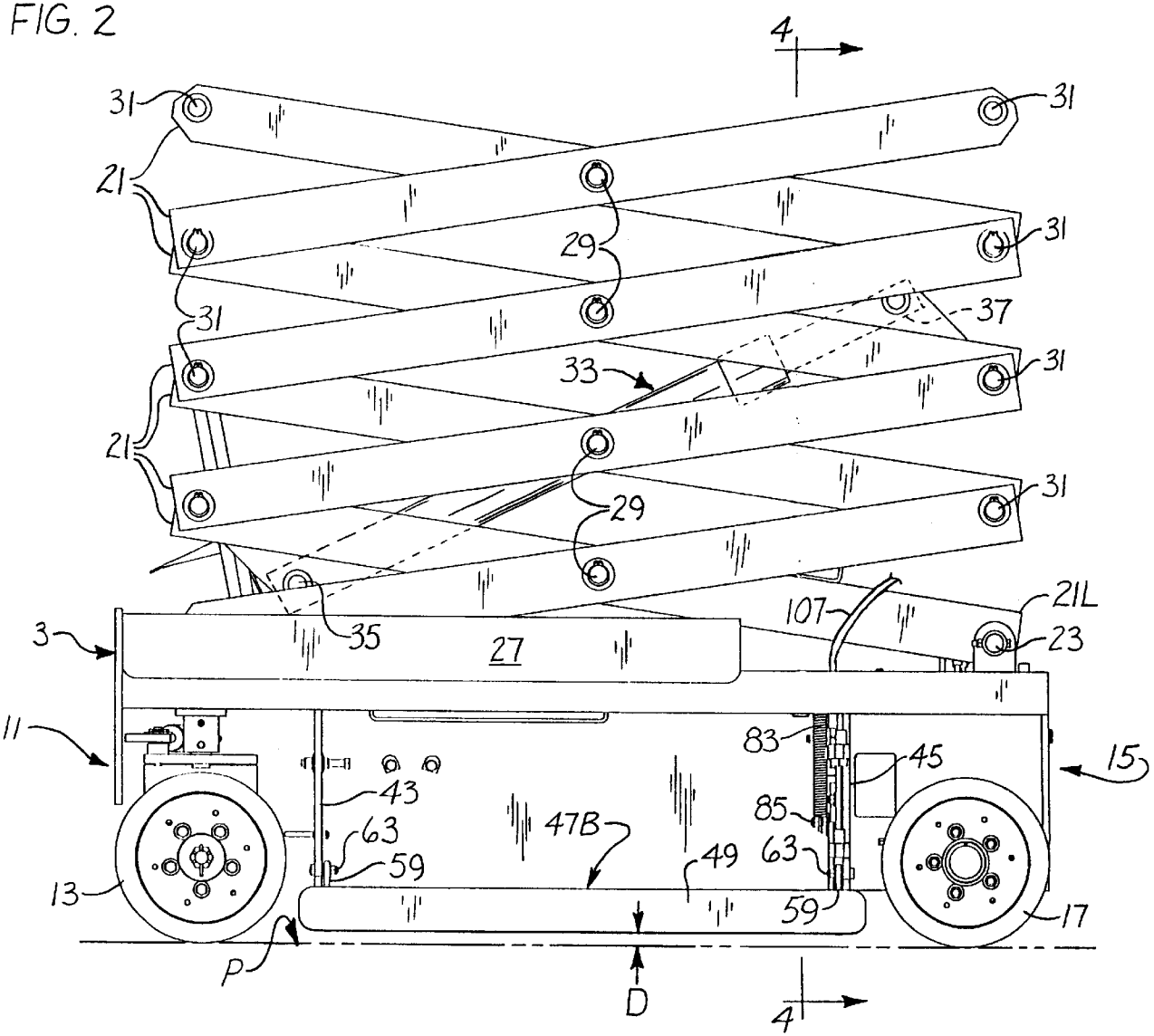
FIG. 2 is a view in side elevation showing the scissors lift expanded vertically upward to raise the work platform upward to elevated position, the platform being omitted.
Figure 3:
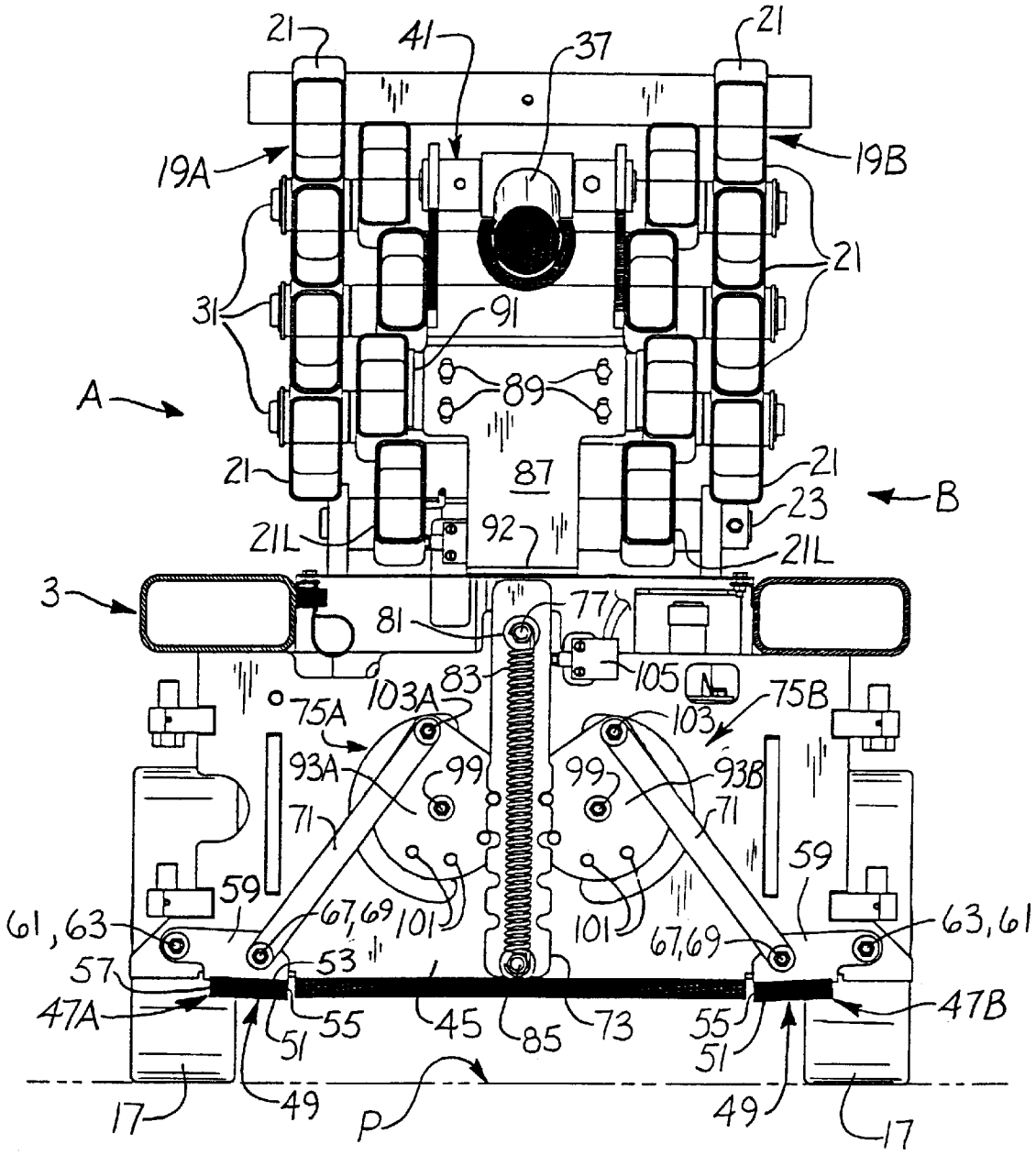
FIG. 3 is a vertical transverse section generally on line 3—3 of FIG. 1.
Figure 4:
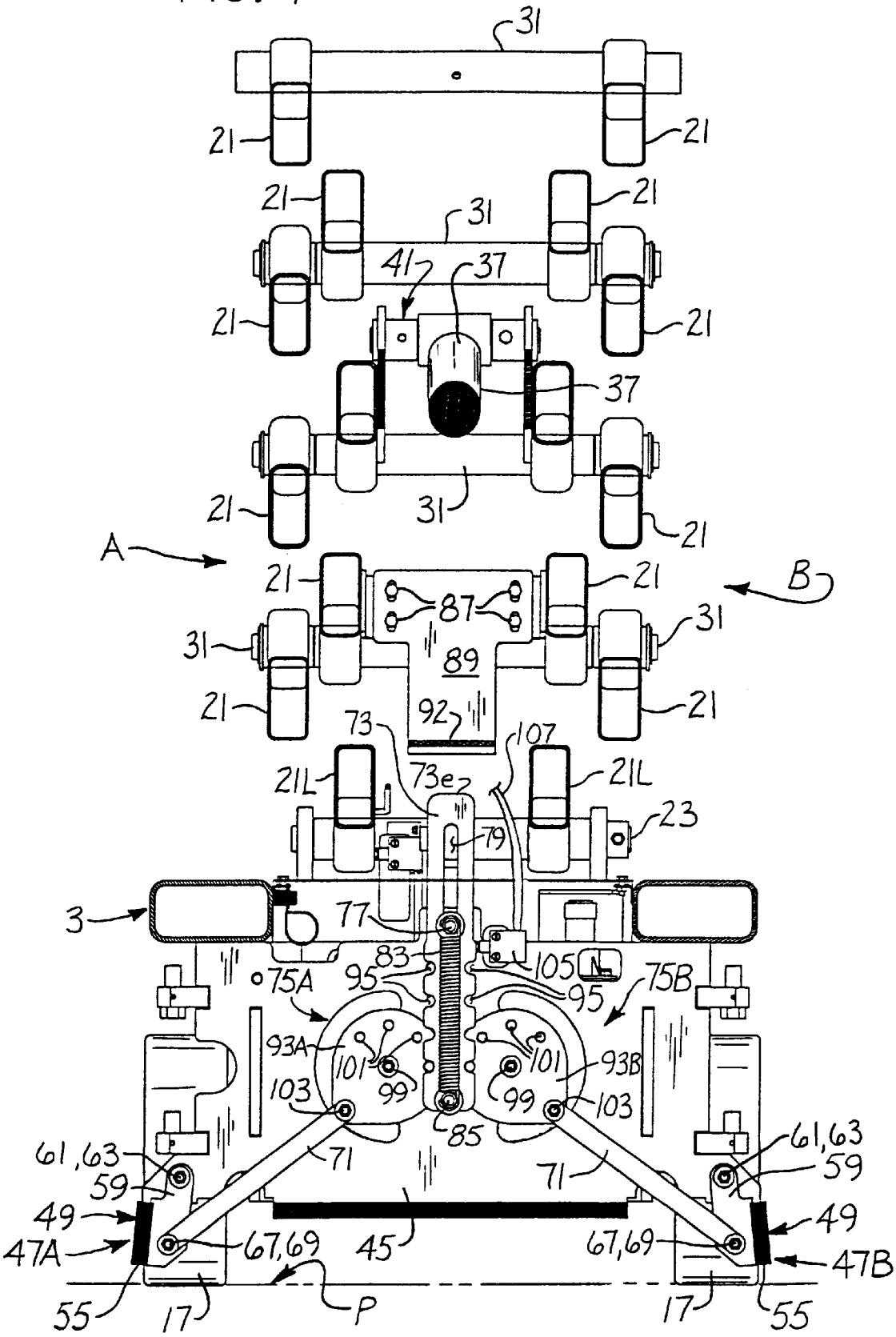
FIG. 4 is a vertical transverse section generally on line 4—4 of FIG. 2.
Figure 5:
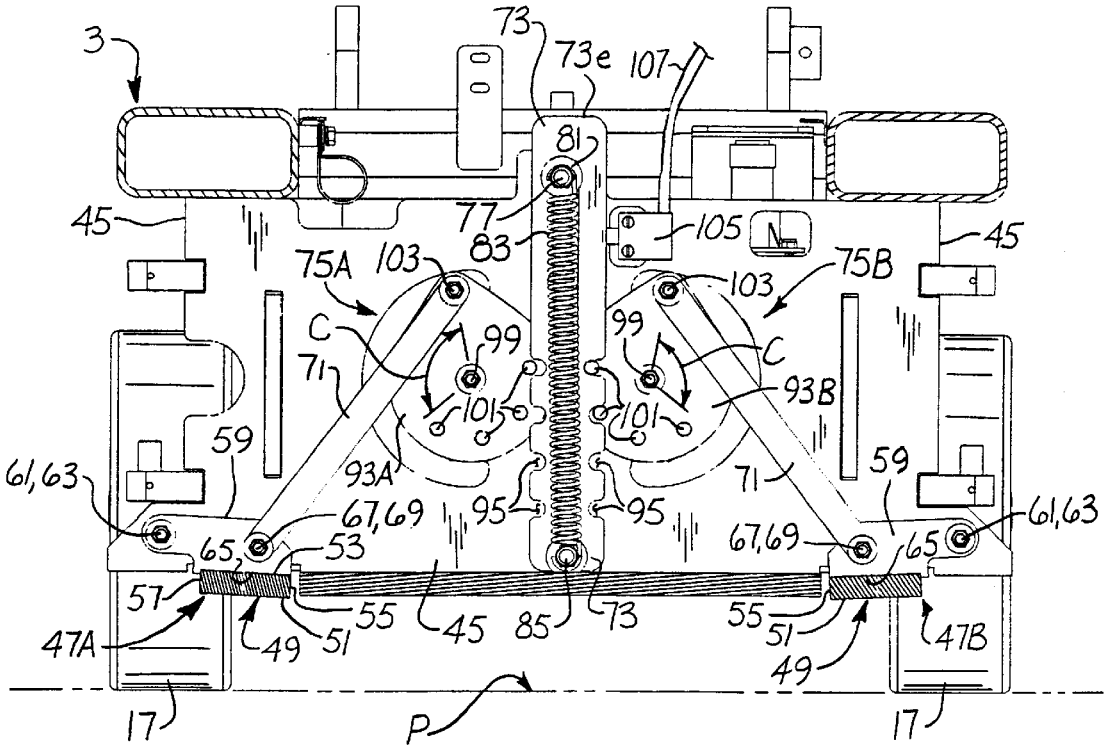
FIG. 5 is an enlargement of the lower part of FIG. 3.
Figure 6:
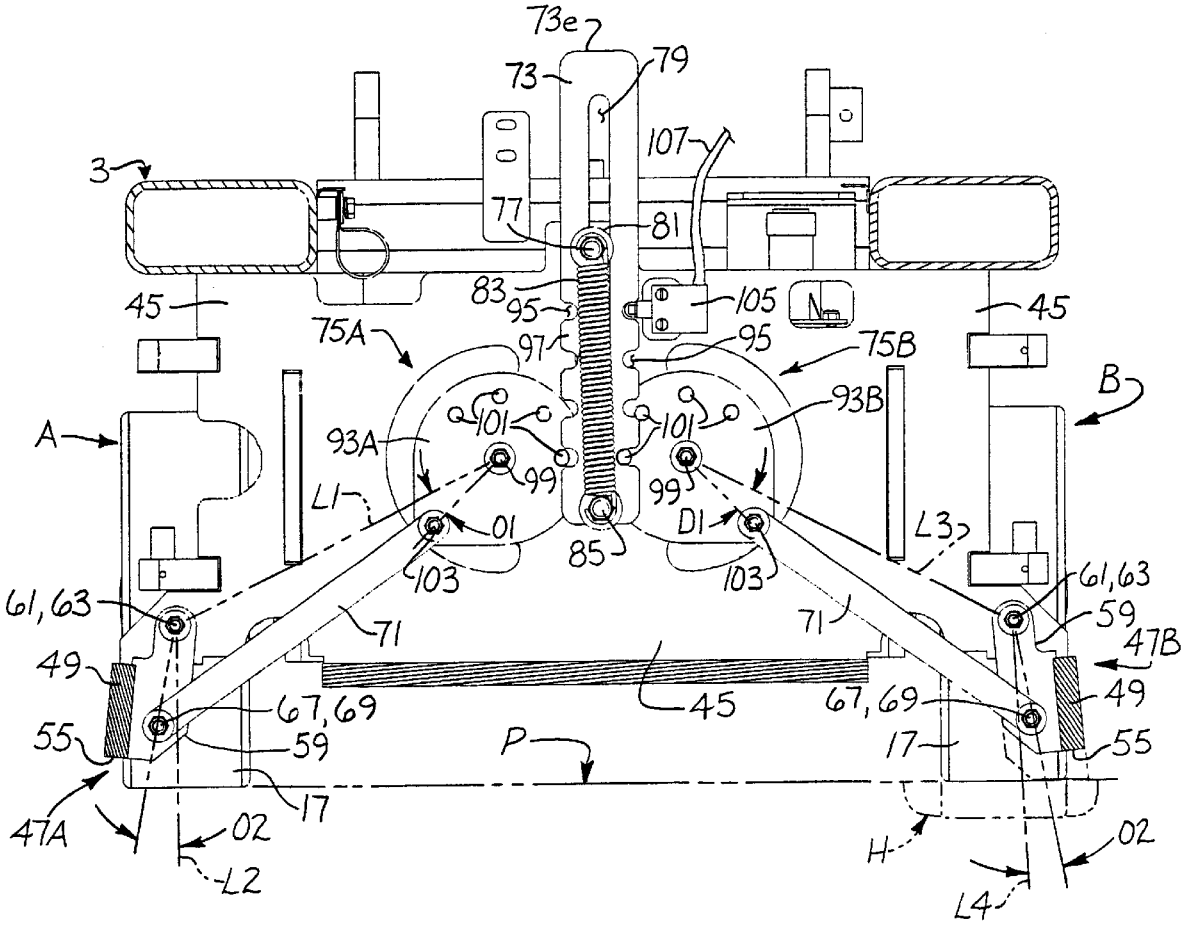
FIG. 6 is an enlargement of the lower part of FIG. 4

When the rack 73 (the drawbar) is driven down to its lowered position (FIGS. 1, 3 and 5) on lowering of the scissors lift 7, the rack rotates the pinions 93A and 93B (via the pins 101 on the pinions) to the position shown in FIGS. 2, 4 and 6 wherein the crank pins 103 on the pinions are in a relatively raised position. More particularly, the pinion 93A of the mechanism 75A occupies the angular position wherein the crank pin 103 of that mechanism is just to the left of the 12 o'clock position and the pinion 93B of mechanism 75B occupies the position wherein the crank pin 103 of that mechanism is just to the right of the 12 o'clock position as viewed in FIG. 5. When the rack 73 moves up to its raised position shown in FIG. 6 under the bias of spring 83 on elevation of the scissors lift 7, the rack rotates the pinion 93A of mechanism 75A counterclockwise through angle C (e.g., about 135°) and rotates the pinion 93B of mechanism 75B clockwise through angle C (e.g., about 135°) bringing the crank pin 103 of mechanism 75A around to about the 7:30 o'clock position and bringing the crank pin 103 of mechanism 75B around conversely to about the 4:30 o'clock position.

As the crank pin 103 of mechanism 75A rotates counterclockwise through the stated arc (e.g., about 135°) it drives the link or connecting rod 71 of mechanism 75A toward side A of the vehicle to swing the arm 59 carrying the stabilizer bar 49 at that side down from its aforesaid FIGS. 1, 3, 5 raised retracted position to its lowered (active) position (FIGS. 2, 3, 6). Concomitantly, as the crank pin 103 of mechanism 75B rotates clockwise through the arc of 135° it drives the link or connecting rod 71 of mechanism 75B toward side B of the vehicle to swing the arm 59 carrying the stabilizer bar 49 at that side down from its raised retracted position to its lowered (active) position. Each stabilizer bar 49, when in the lowered (active) position, with the scissors lift 7 raised, is engageable with the surface traversed by the vehicle upon downward movement thereof through the surface clearance distance D should for any reason the apparatus start tilting. For example, as illustrated in phantom at the lower right of FIG. 6, should one or more wheels 13, 17 of the vehicle encounter a pothole H in the pavement P on which the vehicle is moving and the apparatus thereby tilts toward side B, the stabilizer bar 49 on the B side comes down for engagement of its edge 55 with the pavement and precludes further tilting of the apparatus.

When the rack 73 moves up on the raising of the lift 7 and the crank pin 103 of mechanism 75A rotates counterclockwise from its approximately 12 o'clock position to its approximately 7:30 o'clock position, it moves down across the line L1 between the pivot 99 for the pinion 93A of mechanism 75A and the pivot 63 of the arm 59 on the A side of the apparatus, going past said line L1 and thus overcentering it to the extent of the overcenter angle indicated at O1 in FIG. 6. Also, when the arm 59 on the A side swings down from its FIG. 5 raised retracted position to its FIG. 6 lowered active position, the pivot connection 67 of the respective link 71 connected to that arm 59 moves outwardly toward the A side of the apparatus across the vertical line L2 through the pivot 63 for that arm, going past said line L2 and thus overcentering the arm to the extent of the overcenter angle indicated at O2 at the left of FIG. 6.

Similarly, when the rack 73 moves up on the raising of the lift 7 and the crank pin 103 of mechanism 75B rotates clockwise from its approximately 12 o'clock position to its approximately 4:30 o'clock position, it moves down across the line L3 between the pivot 99 for the pinion 93B of mechanism 75B and the pivot 63 of the arm 59 on the B side of the apparatus, going past the line L3 and thus overcentering it to the extent of the overcenter angle indicated also at O1 at the right of FIG. 6. Also, when the arm 59 on the B side swings down from its FIG. 5 raised retracted position to its FIG. 6 lowered active position, the pivot connection 67 of the respective link 71 connected to that arm 59 moves outwardly toward the B side of the apparatus across the vertical L4 through the pivot 63 for that arm, going past the line L4 and thus overcentering the arm to the extent of the overcenter angle indicated at O2 at the right of FIG. 6.

The overcentering of the crank pins 103 and the overcentering of the arms 59 provides for double-locking the stabilizer bars 49 in their down position, eliminating the need for extra locking mechanism as in the aforesaid U.S. Pat. No. 5,890,737.

At 105 is indicated a rack-actuated switch powered by an electrical cord 107 for sensing when the rack is up and the stabilizer bars 49 are in their fully deployed lowered positions. If the switch 105 is not activated when the scissors rise, indicating that the stabilizer bars 49 are not fully deployed due to an obstruction under the bars, for example, the switch is operable to cut out the lift and drive functions of the vehicle to prevent movement of the vehicle and rise of the work platform 5 above a predetermined height (e.g., six feet).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense. For example, it will be understood that the drawbars 73 could have other configurations, and that the mechanisms operable by the drawbars for moving the stabilizer bars 49 could take other forms without departing from the scope of this invention. Also, the stabilizer bars 49 could comprise members other than rectangular-section bars of the type shown in the drawings.

What is claimed is:

1. Aerial work platform apparatus comprising a vehicle;

a work platform;

a lift on the vehicle for elevating and lowering the work platform;

a stabilizer for inhibiting tipping over of the apparatus when the work platform is elevated, mounted on the vehicle for movement between a raised retracted position and a lowered position for engagement with the surface traversed by the vehicle should the apparatus start tipping;

a drawbar mounted on the vehicle for generally vertical reciprocation movable up on rise of the lift and down in response to lowering of the lift; and mechanism operable by the drawbar having a connection with the stabilizer for moving the stabilizer up to its raised retracted position on lowering the lift with accompanying downward movement of the drawbar and down to its lowered position on rise of the lift with accompanying upward movement of the drawbar.

2. Aerial work platform apparatus as set forth in claim 1 wherein the stabilizer is pivoted on the vehicle for swinging movement between its raised retracted position and its lowered position.

3. Aerial work platform apparatus as set forth in claim 2 wherein said mechanism is operable with an overcentering action for holding the stabilizer in its lowered position.

4. Aerial work platform apparatus as set forth in claim 3 wherein the overcentering action is a double overcentering action.

5. Aerial work platform apparatus as set forth in claim 1 wherein said mechanism comprises a crank mounted on the vehicle for rotation between an advanced and a retracted position in response to rise and lowering of the lift, and a link connecting the crank with the stabilizer for moving the stabilizer between its lowered and retracted positions on rotation of the crank to its advanced position and to its retracted position.

6. Aerial work platform apparatus as set forth in claim 5 wherein said crank comprises a pinion rotatable on a horizontal axis on the vehicle having a crank pin thereon, said drawbar comprising a rack acting on the pinion, said link connecting the crank pin with the stabilizer.

7. Aerial work platform apparatus as set forth in claim 6 wherein the stabilizer comprises a bar having arms thereon pivoted on the vehicle for swinging movement of the bar between a raised retracted position and a lowered position, said link being connected to one of said arms.

8. Aerial work platform apparatus as set forth in claim 7 wherein said crank pin overcenters with respect to a line between said axis of the pinion and said one of said arms as said pinion moves from retracted to advanced position.

9. Aerial work platform apparatus as set forth in claim 8 wherein said one of said arms overcenters with respect to the vertical line through the pivot for said one of said arms as it swings from its raised retracted position to its lowered position for a double overcentering action of said mechanism.

10. Aerial work platform apparatus as set forth in claim 7 wherein said one of said arms overcenters with respect to the vertical line through the pivot for said one of said arms as it swings from its raised retracted position to its lowered position.

11. Aerial work platform apparatus comprising a vehicle;

a work platform;

a lift on the vehicle for elevating and lowering the work platform;

two stabilizers for inhibiting tipping over of the apparatus when the work platform is raised, each extending longitudinally of the vehicle, one at one side and the other at the other side of the vehicle, each stabilizer comprising a bar mounted on the vehicle for movement between a raised retracted position and a lowered position for engagement with the surface traversed by the vehicle;

a drawbar mounted on the vehicle for generally vertical reciprocation movable up on rise of the lift and down in response to lowering of the lift;

two drawbar-operated stabilizer operating mechanisms, one for the one stabilizer and the other for the other stabilizer, each of said mechanisms being operable by the drawbar and having a connection with the respective stabilizer for moving the respective stabilizer up to its raised retracted position on lowering the lift with accompanying downward movement of the drawbar and down to its lowered position on rise of the lift with accompanying upward movement of the drawbar.

12. Aerial work platform apparatus as set forth in claim 11 wherein each stabilizer bar is pivoted on the vehicle for swinging movement between its'raised retracted position and its lowered position.

13. Aerial work platform apparatus as set forth in claim 12 wherein each said mechanism is operable with overcentering action for holding the respective stabilizer bar in its lowered position.

14. Aerial work platform apparatus comprising a vehicle;

a work platform;

a scissors lift on the vehicle for elevating and lowering the work platform;

two stabilizers for inhibiting tipping over of the apparatus when the scissors lift is raised to elevate the work platform, each stabilizer extending longitudinally of the vehicle, one at one side and the other at the other side of the vehicle, each comprising a bar having arms thereon pivoted on the vehicle for swinging movement on a generally horizontal axis extending longitudinally of the vehicle between a raised retracted position wherein the arms extend inward from the respective side and a lowered position extending downward for engagement with the surface traversed by the vehicle;

a double-sided rack mounted on the vehicle for generally vertical reciprocation between a lowered retracted position and a raised position movable up to its raised position on rise of the scissors lift and down to its retracted position in response to lowering of the lift;

two pinions, one on each side of the rack, each having a crank pin thereon and each mounted on the vehicle for rotation by the rack on a horizontal axis between a retracted position and an advanced position of the crank pin; and two links extending transversely of the vehicle, each interconnecting a respective crank pin and a respective stabilizer arm for swinging of the stabilizer bars to their lowered position on upward movement of the rack in response to rise of the lift and to their retracted position on downward movement of the rack on lowering of the lift.

15. Aerial work platform apparatus as set forth in claim 14 wherein each crank pin overcenters with respect to the line between the respective pinion pivot and the respective stabilizer arm as the respective crank pin moves from retracted to advanced position.

16. work platform apparatus as set forth in claim 15 wherein said respective stabilizer arm overcenters with respect to a vertical line through the pivot for said respective stabilizer arm as it swings from its raised retracted position to its lowered position for a double overcentering action.

17. Aerial work platform apparatus as set forth in claim 14 wherein said respective stabilizer arm overcenters with respect to a vertical line through the pivot for said respective stabilizer arm as it swings from its raised retracted position to its lowered position.

18. Aerial work platform apparatus comprising a vehicle;

a work platform;

a lift on the vehicle for elevating and lowering the work platform;

a stabilizer extending lengthwise of the vehicle when the work platform is elevated, mounted on the vehicle for movement between a raised retracted position and a lowered position for engagement with the surface traversed by the vehicle should the apparatus start tipping;

mechanism for moving the stabilizer up to its raised retracted position on lowering the lift and down to its lowered position on rise of the lift, said mechanism comprising a crank mounted on the vehicle for rotation on an axis extending lengthwise of the vehicle between a retracted angular position and an advanced angular position, said crank being rotatable from the retracted to the advanced position on rise of the lift and from the advanced position to the retracted position on lowering of the lift, and a link extending transversely of the vehicle interconnecting the crank and stabilizer for moving the stabilizer up to its raised retracted position on the rotation of the crank on lowering the lift and down to its lowered position on the reverse rotation of the crank on rise of the lift.

* * * * *